US012339097B2

(12) United States Patent
Loebig

(10) Patent No.: US 12,339,097 B2
(45) Date of Patent: Jun. 24, 2025

(54) SYSTEM AND METHOD OF DIGITAL FOCAL PLANE ALIGNMENT FOR IMAGER AND WEAPON SYSTEM SIGHTS

(71) Applicant: EOTech, LLC, Plymouth, MI (US)

(72) Inventor: Dean Loebig, Howell, MI (US)

(73) Assignee: EOTech, LLC, Plymouth, MI (US)

( * ) Notice: Subject to any disclaimer, the term of this patent is extended or adjusted under 35 U.S.C. 154(b) by 560 days.

(21) Appl. No.: 17/807,571

(22) Filed: Jun. 17, 2022

(65) Prior Publication Data

US 2022/0404121 A1 Dec. 22, 2022

Related U.S. Application Data

(60) Provisional application No. 63/211,758, filed on Jun. 17, 2021.

(51) Int. Cl.
*F41G 1/17* (2006.01)
*F41G 1/30* (2006.01)
*F41G 1/38* (2006.01)

(52) U.S. Cl.
CPC ..... *F41G 1/17* (2013.01); *F41G 1/30* (2013.01); *F41G 1/38* (2013.01)

(58) Field of Classification Search
CPC ... G02B 23/12; F41G 1/38; F41G 1/30; F41G 1/033
See application file for complete search history.

(56) References Cited

U.S. PATENT DOCUMENTS

2006/0164704 A1 7/2006 Sieczka et al.
2008/0037110 A1 2/2008 Gaber
2014/0110483 A1 4/2014 Benson
2014/0226214 A1* 8/2014 Edwards ..... G02B 27/0101 359/630
2015/0369565 A1* 12/2015 Kepler ..... G02B 27/106 348/143
2017/0115096 A1 4/2017 Zhang et al.
2017/0176142 A1 6/2017 Zhang et al.
2019/0377171 A1* 12/2019 Hammond ..... F41G 3/12
2020/0272044 A1* 8/2020 Walker ..... F41G 11/003
(Continued)

FOREIGN PATENT DOCUMENTS

JP 2017519251 A 7/2017

OTHER PUBLICATIONS

International Search Report for Application No. PCT/US2022/073028; mailed Mar. 6, 2023; 3 pp.

*Primary Examiner* — Jonathan Y Jung
(74) *Attorney, Agent, or Firm* — Bodman PLC

(57) ABSTRACT

A weapon system has an optical sight mounted to a weapon and a frame with a sight window that is configured to superimpose a reticle that is visible through the sight window in a first focal plane. An optoelectronic device is mounted to the weapon and includes an imager with a sensor array and a display device. An image processor is configured to receive image data captured by the sensor array and process the image data to generate a subset image that is received from a select region of the sensor array. The select region of the sensor array defines a second focal plane. A controller is configured to receive an input from an operator, and in response to the input, to select the select region of the sensor array for aligning the second focal plane with the first focal plane.

20 Claims, 4 Drawing Sheets

(56) References Cited

U.S. PATENT DOCUMENTS

| | | | | |
|---|---|---|---|---|
| 2020/0400944 | A1 | 12/2020 | Burnsed et al. | |
| 2021/0302128 | A1* | 9/2021 | Ferren | F41G 3/2661 |
| 2021/0372737 | A1 | 12/2021 | Masarik et al. | |

* cited by examiner

SYSTEM AND METHOD OF DIGITAL FOCAL PLANE ALIGNMENT FOR IMAGER AND WEAPON SYSTEM SIGHTS

CROSS-REFERENCE TO RELATED APPLICATION

This application claims priority under 35 U.S.C. § 119(e) to U.S. Provisional Patent Application No. 63/211,758, filed Jun. 17, 2021, the disclosure of this prior application is considered part of this application and is hereby incorporated by reference in its entirety.

TECHNICAL FIELD

The present disclosure relates to imagers and optics for weapon systems, and more particularly to imager systems used or integrated with optical sights, such as on weapons or weapon systems.

BACKGROUND

Firearms and other hand-held weapons, such as bows, are commonly provided with optical sights that provide a reticle in the field of view to aid in aiming the weapon. Conventional sporting/combat optical sights often use holographic optics that, when viewed through a glass optical window, superimpose a holographic image of a reticle at a distance in the field of view. The hologram image of the reticle is illumined by a laser diode in the holographic sight and is projected parallel to and a relatively short vertical distance from the barrel or aiming axis of the firearm upon which the sight is mounted.

It is known to position a low-light digital camera or a digital night vision optic in front of the optical sight, such that the projected reticle image is superimposed in the field of view imaged by the camera or digital optical device. The digital optical device may be mounted to the weapon with fixtures and mounting devices that are mechanically adjusted with shims, risers, and the like to roughly align the optical window of the optical sights. These mounting techniques and mechanical adjustments can be unreliable and create instability on the weapon.

SUMMARY

The present disclosure provides a weapon system that includes an optical sight and an optoelectronic device that is digitally aligned with the focal plane of the optical sight to display a desired and accurate viewing frame to the operator of the weapon. In one aspect of the disclosure, the optical sight includes a base that is configured to mount to a weapon and a frame that is coupled to the base. The frame of the optical sight has a sight window that is configured to superimpose a reticle that is visible through the sight window in a first focal plane. The optoelectronic device has a mounting feature configured to mount to the weapon and an imager with a sensor array configured to receive light from an objective end of the optoelectronic device, where the objective end is configured to face the optical sight when the optoelectronic device is attached to the weapon. An image processor is configured to receive image data captured by the sensor array and process the image data to generate a subset image that is received from a select region of the sensor array. The select region of the sensor array defines a second focal plane. A controller is configured to receive an input from an operator, and in response to the input, to select the select region of the sensor array for aligning the second focal plane with the first focal plane. A display device is configured to display the subset image to the operator of the weapon.

Implementations of the disclosure may include one or more of the following optional features. In some implementations, the sensor array of the imager includes a plurality of photosensitive pixels disposed in a grid, such that the select region of the sensor array includes a grouped subset of the plurality of photosensitive pixels in the grid. In some examples, the input may indicate a directional adjustment that is configured to move the select region to an adjacent grouped subset of the plurality of photosensitive pixels in the grid. In other examples, the input may indicate a size adjustment that is configured to increase or decrease the area of the select region to a corresponding larger or smaller grouped subset of the plurality of photosensitive pixels in the grid. A border of the subset image may be framed at an edge of the sight window when the second focal plane is aligned with the first focal plane.

In additional implementations, the optoelectronic device includes at least one of a low-light digital camera or a thermal imager. In some examples, the imager includes a CMOS sensor or CCD sensor. Also, implementations of the optical sight include a holographic optic that has a light source disposed at the base and an optical element configured to project the reticle illumined by the light source through the sight window in the first focal plane.

In further implementations, the display device is disposed at an eye piece end of the optoelectronic device opposite the objective end. In some examples, an optical magnifier may be disposed at the eye piece end of the optoelectronic device to magnify the display subset image to the operator.

In other implementations, the weapon system includes a remote device that is wirelessly connected to the optoelectronic device and is configured to provide the input to the controller to select the select region of the sensor array. In some examples, the remote device includes a display that is configured to display a stream of the subset image.

Another aspect of the disclosure provides a method that involves generating a holographic reticle in a first focal plane of an optical sight that is mounted to a weapon. An optoelectronic device is mounted to the weapon with an objective end of the optoelectronic device facing the optical sight. An imager of the optoelectronic device captures image data and transmits the image data to an image processor that generates a subset image from a select region of the imager that defines a second focal plane. The subset image is displayed to the operator of the weapon at an eye piece of the optoelectronic device. The select region of the imager is altered in response to inputs from the operator to align the second focal plane with the first focal plane.

Each of the above independent aspects of the present disclosure, and those aspects described in the detailed description below, may include any of the features, options, and possibilities set out in the present disclosure and figures, including those under the other independent aspects, and may also include any combination of any of the features, options, and possibilities set out in the present disclosure and figures.

The details of one or more implementations of the disclosure are set forth in the accompanying drawings and the description below. Other aspects, advantages, purposes, and features will be apparent upon review of the following specification in conjunction with the drawings.

BRIEF DESCRIPTION OF THE DRAWINGS

Like reference numerals indicate like parts throughout the drawings.

DETAILED DESCRIPTION

Figure 1:
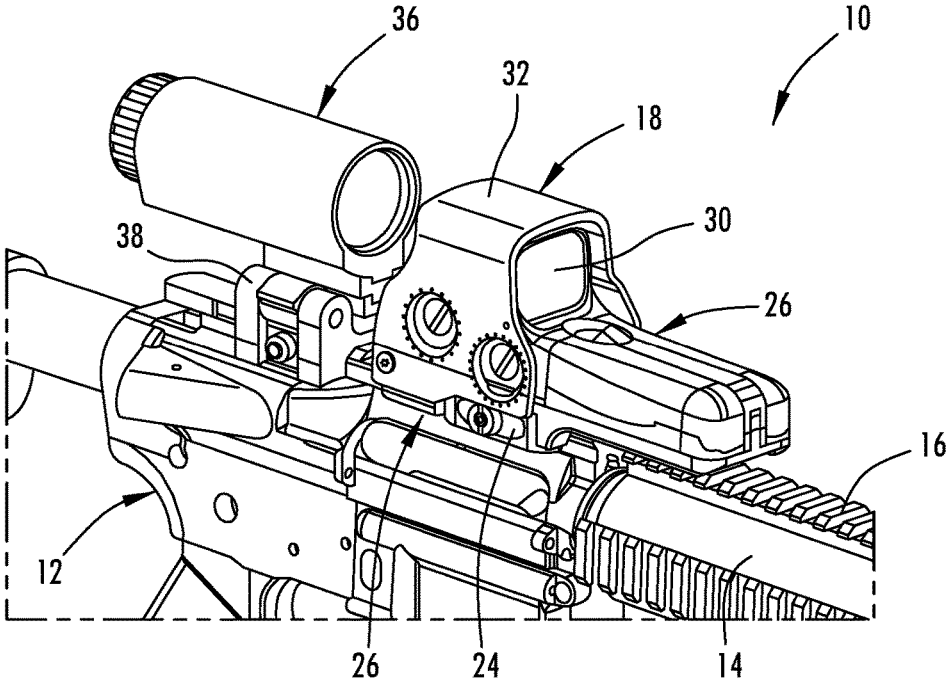
FIG. 1 is a perspective view of an imager system and an optical sight mounted on a weapon system.

Referring now to the drawings and the illustrative examples depicted therein, a weapon system 10, such as partially shown in FIG. 1, includes a weapon 12 used for sporting or combat that requires aiming by the operator, such as a hand held weapon capable of shooting a projectile. The term "hand held" when used in reference to the weapon includes, for example, a rifle, a shotgun, a handgun, a pistol, a bow, or any other weapon commonly used in a hand held manner. The weapon 12 includes a barrel 14 or other projectile containment mechanism that defines a projectile axis. To assist with aiming the projectile axis at a target, the weapon may include fixed sights, such as iron sights, that have markers optically aligned with the projectile axis of the weapon. Also, the weapon 12 may include a rail 16, such as a Weaver or Picatinny rail, which extends at least partially along the upper surface of the barrel 14 for mounting optical sights and devices, among other weapon accessories. The rail 16 may further extend along an upper surface of the receiver, frame, grip, or other portion of the weapon 12. As shown in FIG. 1, the weapon 12 is a rifle (i.e., an ArmaLite rifle) that has a barrel 14 with a Picatinny rail 16.

The weapon system 10, such as shown in FIG. 1, also includes an optical sight 18 that superimposes a marker or reticle 20 (FIG. 3) in the field of view to aid in aiming the weapon 12. The optical sight 18 includes a base 22 that is configured to mount to the weapon, such as with a mounting mechanism 24 attached to the rail 16. Various types of mounting mechanisms may be employed depending upon the type of weapon and rail system. The optical sight 18 also includes a body 26 that houses a light source, a power source, a control, and optical elements, among any other optical or electronic components of the optical sight. A frame 28 (FIG. 3) of the optical sight 18 is integrally or separately coupled with the body 26 to extend upward from the body 26 and define a sight window 30 having at least one glass pane or lens occupying the sight window 30. As also shown in FIGS. 1-3, the optical sight 18 may include a protective shroud or hood 32 that extends over the frame 28, such as at a spaced distance, so as to prevent damage or jarring the body of the optical sight and components housed therein.

Figure 2:
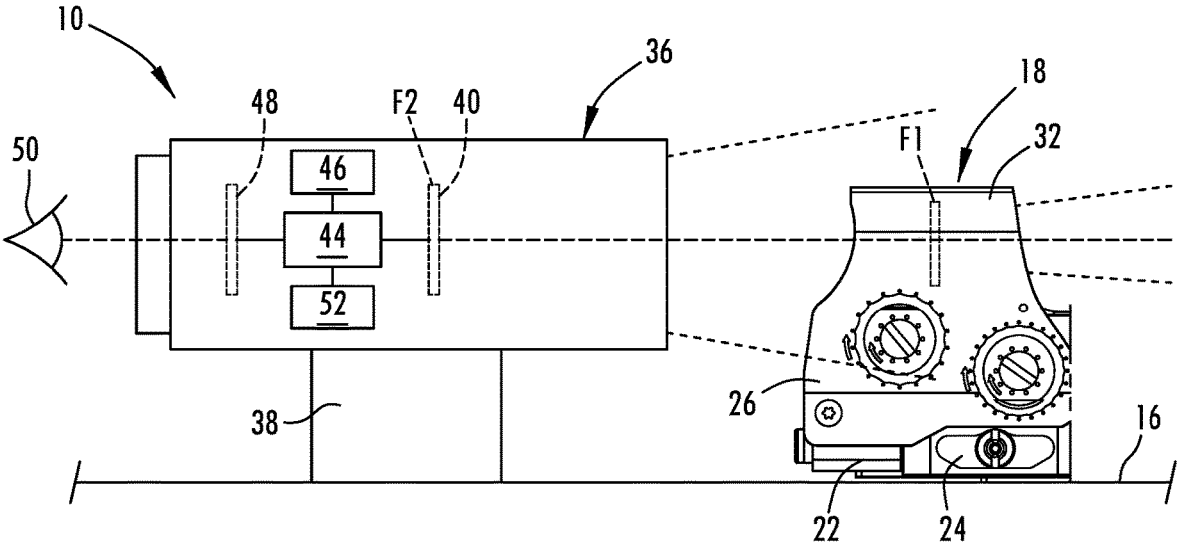
FIG. 2 is a side schematic view of an imager system and an optical sight.
Figure 3:
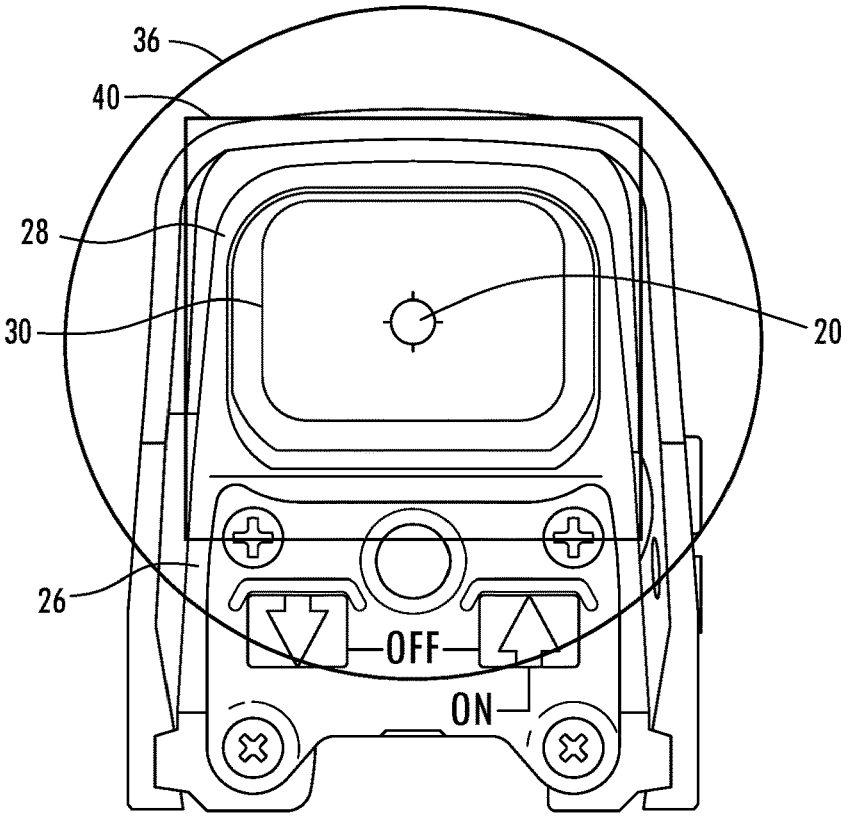
FIG. 3 is a rear schematic view of an imager system and an optical sight.

As shown for example in FIGS. 1-3, the optical sight 18 is a holographic sight that uses a laser diode in combination with optical elements, such as a collimator and reflection grating, to superimpose the holographic image of a reticle 20 over the direct view of the target scene when viewed through the sight window 30. The view through the sight window 30 thereby defines a focal plane of the target scene, which is referenced as part of the weapon system as a first focal plane F1 (FIG. 2). The optical sight 18 projects the reticle 20 parallel to and a relatively short vertical distance from the barrel 14 or projectile axis of the weapon 12 upon which the sight is mounted. In additional implementations, the weapon system may include other types and configurations of optical sights, such as a red dot sight that uses an LED as the light source to generate the reticle in the sight window.

As further shown in FIGS. 1 and 2, the weapon system 10 includes an optoelectronic device 36 that has a mounting feature 38 configured to mount to the weapon 12, for example, at the rail 16. The mounting feature 38 may include a threaded hole at the housing of the optoelectronic device, in addition or in the alternative to a corresponding mounting device that interfaces with the rail 16 of the weapon 12. The mounting feature 38 may be configured with adapters, risers, and vibration dampening materials. The optoelectronic device 36 may be mounted to the weapon 12 proximally to optical sight 18 and directed with the objective end of the optoelectronic device 36 facing toward the optical sight 18 and the distal or muzzle end of the weapon 12.

The optoelectronic device 36 includes an imager 40 with a sensor array 42 (FIG. 4) configured to receive light from the objective end of the optoelectronic device 36. The imager 40 is a CMOS sensor and in additional examples may be various types of imagers, such as a CCD sensor or other type MOS sensor or the like, such as an image sensor configured to sense low-light and/or infrared (IR) wavelengths. Thus, in some examples, the optoelectronic device may be a low-light digital camera or a thermal imager. The sensor array 42 of the imager 40 is configured to capture the reticle 20 generated by the optical sight 18 in dark or low light conditions. The imager 40 generates image data in the form of one or more signals from the sensor array 42 that can be processed by an image processor 44.

Figure 4:
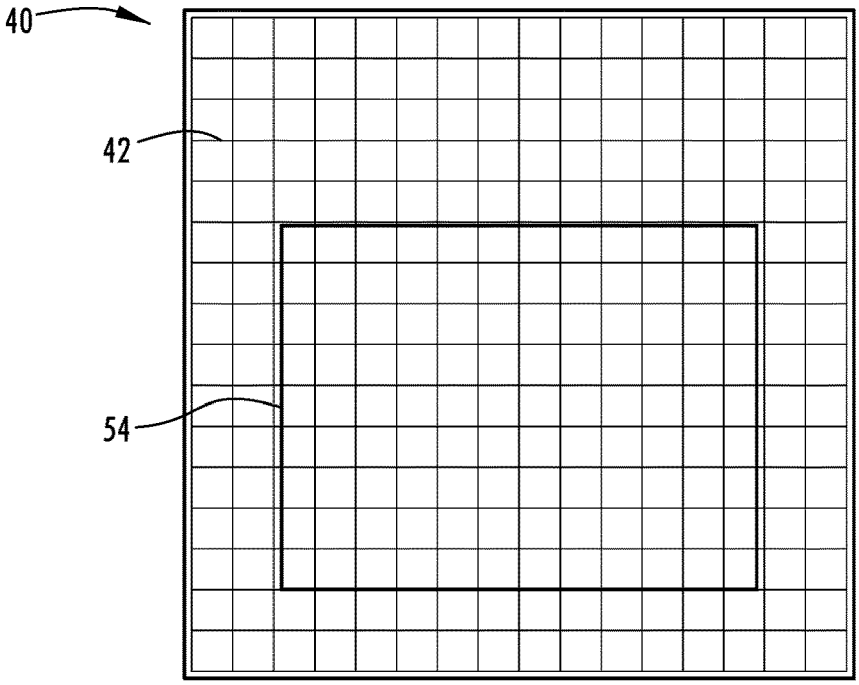
FIG. 4 is a diagram of the imager system pixel array showing a sensing region.

The sensor array 42 (FIG. 4) may include a printed circuit board assembly (PCBA) having a matrix of sensor elements. Each sensor element may be uniquely identifiable according to an addressable location on the sensor array 42 PCBA. For example, the sensor elements may be identifiable in an x-coordinate and y-coordinate pair according to the individual sensor element's placement within the number of rows and columns of sensor elements on the sensor PCBA. Specifically, a first sensor element in an arbitrary bottom-left corner may be addressable as element (1, 1), and a second sensor element in the opposite, top-right corner may be addressable as element (1000, 1000), for a sensor having 1,000 rows and 1,000 columns of individual sensor elements. In this example, the imager 40 would therefore be characterized as a 1 megapixel (1 MP) optical sensor having one million active sensor elements. As illustrated in FIG. 4, the sensor array 42 comprises a matrix of 256 sensor elements arranged in 16 columns and 16 rows. The information extracted from one sensor element corresponds to one picture-element (pixel) in the image data.

Referring now to FIG. 2, an image processor 44 is electrically connected to the imager 40, such as in the low-light digital camera housed in the optoelectronic device 36. In additional examples, the image processor 44 may be disposed in a remote device, such as at a remote display device. In another example, the image processor 44 may be locally disposed within the optoelectronic device 36 and may communicate a signal to a remote device, such as a remote display device (e.g., a portable electronic device, a helmet-mounted device, combat goggles, a heads-up display, or the like). As shown in the component schematic shown in FIG. 2, the image processor 44 receives image data captured and transmitted by the sensor array 42 of the imager 40 and processes the received image data. The image processor 44 runs a processing routine stored in corresponding memory 46 using the received image data to generate an image for output on a display device.

The image processor 44 may process the image data to represent less than the entirety of data generated by the imager 40 on the display device, referred to as a subset image. The subset image simply refers to an image generated from a subset, or less than all, of the image date generated by the imager 40. The subset image corresponds to and is received from a select region 54 of the sensor array 42, such as shown in FIG. 4. As described above in an exemplary manner, where the imager 40 includes the sensor array 42, the select region 54 may extend between sensor element (3, 3) at the lower left corner and sensor element (14, 14) at the upper right. The select region 54 may be encompass more or less of the sensor array 42 than illustrated in FIG. 4. The select region 54 may be sizeable and moveable within the range of the sensor array 42.

The select region 54 of the sensor array 42 defines a second focal plane F2. A display device 48 is configured to display the subset image to the operator 50 of the weapon 12. The display device 48 is disposed at an eye piece end of the optoelectronic device 36 opposite the objective end. The display device 48 may be viewed through a viewfinder window.

In some examples, an optical magnifier may be disposed at the eye piece end of the optoelectronic device to magnify the displayed subset image to the operator. In other examples, the display device 48 may be disposed at a remote location that is detached from the weapon 12, such as at an operator's head-mounted device or at a portable electronic device, such as a computer or smart phone. The remote device may be wirelessly connected to the optoelectronic device 36 and configured to provide an input to a controller 52 to select the select region 54 of the sensor array 42. The optoelectronic device 36, in the controller 52 or with another component, may integrate wireless communication technologies, such as Wi-Fi, Bluetooth, cellular, or other conventional protocols. For example, the remote device may include a display 48 that is configured to display a relatively live stream of the subset image.

With further reference to FIG. 2, the controller 52 is provided at the optoelectronic device 36 that is configured to receive an input from the operator 50, such as in response to actuation of a human-machine interface (HMI), e.g., a button, a switch, a touch screen, or the like. For example, the HMI may be a set of coordinate buttons on the optoelectronic device 36. In response to the input, the controller 52 operates to adjust or otherwise select the select region 54 of the sensor array 42 for aligning the second focal plane F2 with the first focal plane F1. Aligning the second focal plane F2 with the first focal plane F1 refers to coordinating the image displayed at the display 48 to what an operator 50 would be viewing through the optical sight 18 in the absence of the optoelectronic device 36 from the perspective illustrated in FIG. 2, or another perspective selected by the operator 50.

As shown in FIG. 3, the sight window 30 that surrounds or borders the first focal plane F1 is encompassed in the image area captured by the imager 40 of the optoelectronic device 36. For example, as shown in FIG. 4, the sensor array 42 of the imager 40 includes a plurality of photosensitive pixels disposed in a grid. The image processor 44 may use or process the select region 54 of the sensor array 42, such as with the use of a regioning operation saved in the memory 46. The regioning operation refers to processing the image data of the entire sensor array 42 to separate the image data of the select region 54 and generate a subset image from the image data of the select region 54. As illustrated in FIG. 3, the select region 54 and thus the subset image may be limited to correspond to the sight window 30, and the full image area of the imager 40 is not displayed a the display 48. The select region 54 corresponds to a grouped subset of the plurality of photosensitive pixels in the grid of the sensor array 42.

As shown in FIG. 4, the select region 54 is a rectangular grouping of photosensitive pixels in the lower central area of the sensor array 42. The particular configuration of weapon 12, optoelectronic device 36 and optical sight 18 may result in a different select region 54 of the imager 40. It may be necessary to determine a new select region 54 when installing the optoelectronic device 36 to the weapon, when installing a new optical sight 18 to the weapon, when adjusting the weapon to a new operator 50, due to changing operator preferences, or otherwise.

When the regioning operation is processing at the image processor 44, the display device 48 displays the subset image that corresponds to the select region 54. The operator of the weapon may view the display device 48, either at the optoelectronic device or at a remote device, and provide an input to adjust the select region 54. It is contemplated that a configuration routine may also or alternatively be actuated that selectively allows or restricts the received inputs to adjust the select region 54, such as to prevent accidental adjustments when carrying or operating the weapon. The input may indicate a directional adjustment or a sizing adjustment of the select region. In additional examples, it is contemplated that that the input could also adjust the perceived inclination angle of the subset image (e.g., yaw, pitch and roll).

Figure 5:
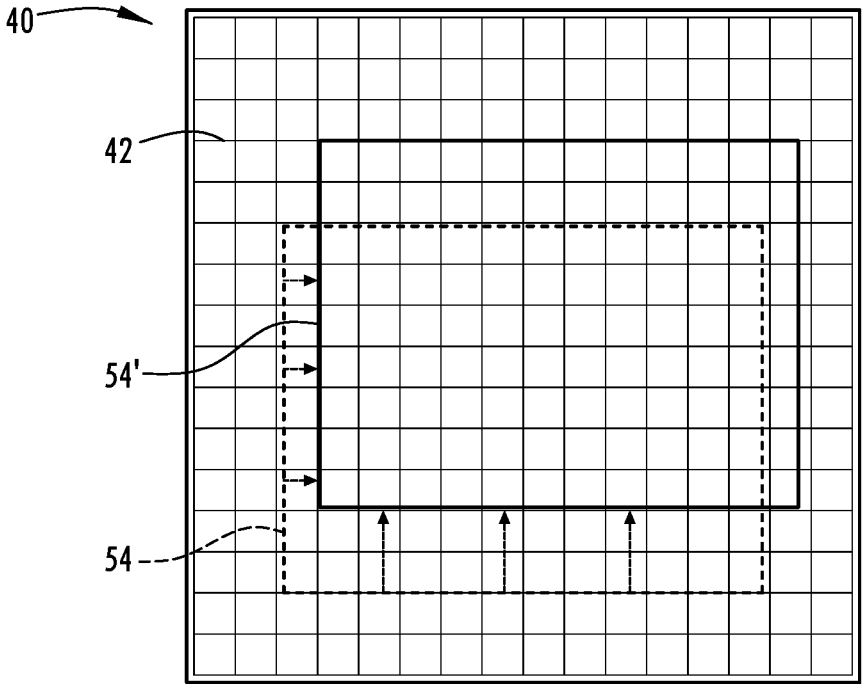
FIG. 5 is a diagram of the imager system pixel array showing movement of the sensing region.

As shown in FIG. 5, the input or inputs may indicate a directional adjustment that is configured to move the select region 54 to an adjacent grouped subset of the plurality of photosensitive pixels in the grid, such that the adjacent grouping overwrites and becomes the new select region 54'. In the directional adjustment, the number of sensor elements comprising the select region 54 remains the same, with the range of sensor elements each indexing an equal amount within the range of the sensor 40. As shown in FIG. 5, the inputs move the select region upward two units and to the right one unit, which may be input as two up coordinate button clicks and one right coordinate button click. In other examples, the input may be an input defined by a user virtually repositioning the select region with a swipe touch event on a touch screen of a remote device.

Figure 6:
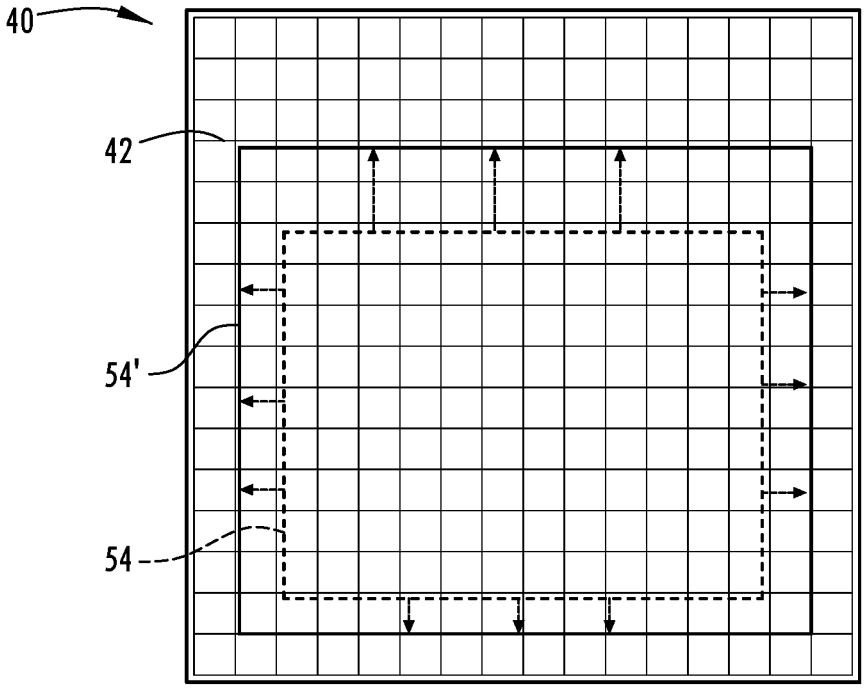
FIG. 6 is a diagram of the imager system pixel array showing enlargement of the sensing region.

Also, as shown in FIG. 6, the input or inputs may indicates a size adjustment that is configured to increase or decrease the area of the select region 54 to a corresponding larger or smaller grouped subset of the plurality of photosensitive pixels in the grid, such that the adjacent grouping overwrites and becomes the new select region 54'. Such sizing may effectively zoom the subset image to an appropriate size to align the first and second focal planes, such as when the distance between the optoelectronic device and the optical sight results in a larger area or a smaller area of the focal plane. In the sizing adjustment, the number of sensor elements comprising the select region 54 will increase the number of sensor elements by zooming out, or will decrease the number of sensor elements by zooming in. Decreasing the number of sensor elements comprising the select region 54 will increase the relative representation of each sensor element on the display 48, respectively.

Other inputs are also contemplated. For example, combinations of directional and sizing adjustments may allow the operator to selectively adjust each border of the select region 54 independently to more precisely align the exact region desired within the range of the imager 40. Specifically, the operator 50 may be provided input options to individually adjust the top border and bottom border of the select region 54 upwards or downward, and to individually adjust the left border and right border to the left and right. In other alternatives, the top and bottom borders may be adjusted together in combination and the left and right borders may be adjusted together in combination.

The skew, or relative rotation of the imager 40 to the sight window 30, may also be adjustable. Variances in manufacturing, wear, or mounting may result in a mismatched rotation between imager 40 and the sight window 30 such that, for example, the borders of the select region 54 do not appear parallel with the borders of the sight window 30. It may therefore be desirable to adjust the subset image output to the display 48 by adjusting the skew of the select region 54. The operator may provide manual input to perform this adjustment. In other alternatives, the operator may provide input to selectively adjust the rotation of each border individually, or in top-bottom and left-right pairs to account for keystone correction.

When operating to select a new select region of the sensor array 42, the second focal plane F2 is desirably aligned with the first focal plane F1. For example, the border of the subset image may be framed at an edge of the sight window when the second focal plane is aligned with the first focal plane.

Figure 7:
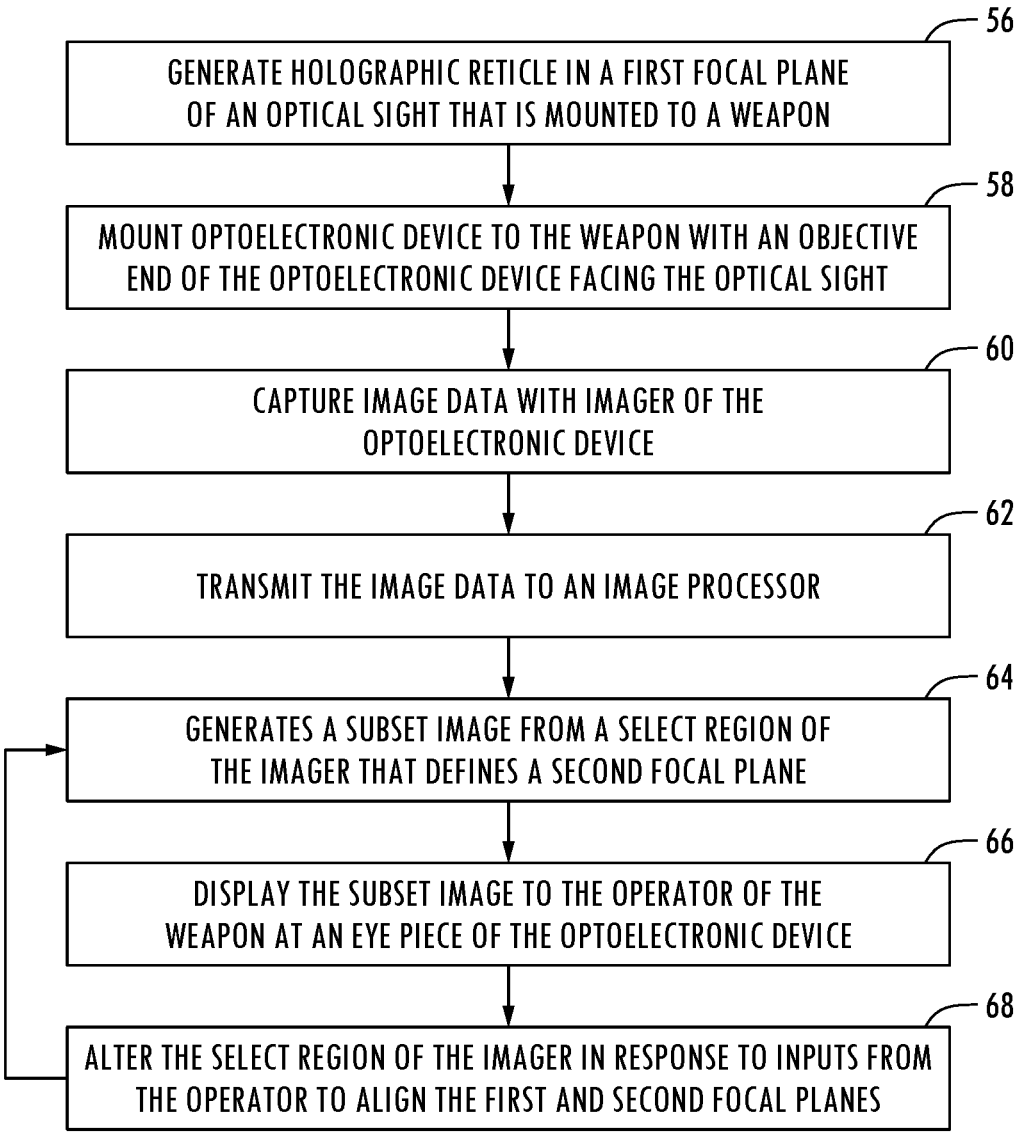
FIG. 7 is a flowchart of a method of digital focal plane alignment for an imager system and an optical sight.

With reference to the method of digital focal plane alignment for imager and sights for weapon systems, such as shown for example in FIG. 7, at step 56 a holographic reticle may be generated in a first focal plane of an optical sight that is mounted to a weapon. At step 58, an optoelectronic device is mounted to the weapon with an objective end of the optoelectronic device facing the optical sight. An imager of the optoelectronic device, at step 60, captures image data and, at step 62, transmits the image data to an image processor. The image processor, at step 64, generates a subset image from a select region of the imager that defines a second focal plane. At step 66, the subset image is displayed to the operator of the weapon at an eye piece of the optoelectronic device. At step 68, the selection the select region of the imager is altered in response to inputs from the operator to align the second focal plane with the first focal plane. After the selection is altered, the new selection continues to be displayed at step 64 until a new input is received that is capable of adjusting the select region. For example, some selections may not result in a new selection, such as when the select region is at an edge of the sensor array.

The step 64 of the method illustrated in FIG. 7 may also be automated and performed by the image processor. The step 64 may be performed as an initial operation following mounting of the optoelectronic device to the weapon, or in response to an operator command to execute automatically. For example, the image processor may store an operation that when executed cause the image processor to process the image data to recognize the presence of a reticle within the image data using conventional optical recognition methods. The image processor may be configured to execute a processing routing stored in memory 46 to retrieve a library of reticle shapes or forms for use in recognizing the present of the reticle within the image data. The image processor may be configured to recognize the bounds of the sight window or the frame within the image data. The image processor may determine a select region based on recognizing one or more of the reticle, the sight window, the frame, or combinations thereof within the image data. For example, the image processor may determine a select region of a defined size centered on the reticle.

The image processor may determine a select region to be defined by the edges of the sight window, or the frame. The image processor may determine a select region to include the edges of the sight window, or the frame, plus some additional margin of peripheral sensor elements. The additional margin of peripheral sensor elements may be defined as a percentage of the subset image. For example, the select region may be determine by the image processor based on the edges of the sight window plus a margin such that the margin does not take up more than 5% of the total subset image. The image processor may store the select region in a memory of the optoelectronic device as a matrix of sensor elements, defined by the address coordinates of the range of sensor elements comprising the select region.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional implementations that also incorporate the recited features. Numbers, percentages, ratios, or other values stated herein are intended to include that value, and also other values that are "about" or "approximately" the stated value, as would be appreciated by one of ordinary skill in the art encompassed by implementations of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

Also for purposes of this disclosure, the terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, the terms "upper," "lower," "right," "left," "rear," "front," "vertical," "horizontal," "distal," "proximal" and derivatives thereof shall relate to the orientation shown in FIG. 1. However, it is to be understood that various alternative orientations may be provided, except where expressly specified to the contrary. It is also to be understood that the specific devices and processes illustrated in the attached drawings, and described in this specification are simply exemplary embodiments of the inventive concepts defined in the appended claims. Hence, specific dimensions and other physical characteristics relating to the embodiments disclosed herein are not to be considered as limiting, unless the claims expressly state otherwise.

Changes and modifications in the specifically described embodiments may be carried out without departing from the principles of the present invention, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

The invention claimed is:

1. A weapon system comprising:

an optical sight having a body configured to mount to a weapon, a frame coupled to the body and comprising a sight window configured to superimpose a reticle that is visible through the sight window in a first focal plane;

an optoelectronic device comprising a mounting feature configured to mount to the weapon and an imager with a sensor array configured to receive light from an objective end of the optoelectronic device, wherein the objective end is configured to face the optical sight when the optoelectronic device is attached to the weapon;

an image processor configured to receive image data captured by the sensor array and process the image data to generate a subset image that is received from a select region of the sensor array, wherein the select region of the sensor array defines a second focal plane;

a controller configured to receive an input from an operator and, in response to the input, to select the select region of the sensor array for aligning the second focal plane with the first focal plane; and a display device configured to display the subset image to the operator of the weapon.

2. The weapon system of claim 1, wherein the sensor array of the imager comprises a plurality of photosensitive pixels disposed in a grid, and wherein the select region of the sensor array comprises a grouped subset of the plurality of photosensitive pixels in the grid.

3. The weapon system of claim 2, wherein the input indicates a directional adjustment that is configured to move the select region to an adjacent grouped subset of the plurality of photosensitive pixels in the grid.

4. The weapon system of claim 2, wherein the input indicates a size adjustment that is configured to increase or decrease the area of the select region to a corresponding larger or smaller grouped subset of the plurality of photosensitive pixels in the grid.

5. The weapon system of claim 1, wherein a border of the subset image is framed at an edge of the sight window when the second focal plane is aligned with the first focal plane.

6. The weapon system of claim 1, wherein the optoelectronic device comprises at least one of a low-light digital camera or a thermal imager.

7. The weapon system of claim 1, wherein the imager comprises a CMOS sensor or CCD sensor.

8. The weapon system of claim 1, wherein the optical sight comprises a holographic optic having a light source disposed at the base and an optical element configured to project a reticle image illumined by the light source through the sight window in the first focal plane.

9. The weapon system of claim 1, wherein the display device is disposed at an eye piece end of the optoelectronic device opposite the objective end.

10. The weapon system of claim 9, further comprising an optical magnifier disposed at the eye piece end of the optoelectronic device to magnify the display subset image to the operator.

11. The weapon system of claim 1, further comprising a remote device wirelessly connected to the optoelectronic device and configured to provide the input to the controller to select the select region of the sensor array.

12. The weapon system of claim 11, wherein the remote device includes a display that is configured to display a stream of the subset image.

13. A method comprising:

generating a holographic reticle in a first focal plane of an optical sight that is mounted to a weapon;

mounting an optoelectronic device to the weapon with an objective end of the optoelectronic device facing the optical sight;

capturing image data with an imager of the optoelectronic device;

processing the image data with an image processor of the optoelectronic device to generate a subset image that is received from a select region of the imager that defines a second focal plane;

displaying the subset image to the operator of the weapon at an eye piece of the optoelectronic device; and altering the selection the select region of the imager in response to input from the operator, wherein the alteration to the select region is configured to align the second focal plane with the first focal plane.

14. The method of claim 13, wherein the imager comprises a plurality of photosensitive pixels disposed in a grid, and wherein the select region of the imager comprises a grouped subset of the plurality of photosensitive pixels in the grid.

15. The method of claim 14, wherein the input indicates a directional adjustment that is configured to move the select region to an adjacent grouped subset of the plurality of photosensitive pixels in the grid.

16. The method of claim 14, wherein the input indicates a size adjustment that is configured to increase or decrease the area of the select region to a corresponding larger or smaller grouped subset of the plurality of photosensitive pixels in the grid.

17. The method of claim 13, wherein a border of the subset image is framed at an edge of the sight window of the optical sight when the second focal plane is aligned with the first focal plane.

18. The method of claim 13, wherein the holographic reticle is co-witnessed with a secondary sight on the weapon.

19. A weapon system comprising:

a sight having a marker that is optically aligned with an aiming axis of a weapon in a first focal plane; and an optoelectronic device having an objective end configured to face the sight, the optoelectronic device comprising:

an imager that includes a sensor array;

a controller configured to receive an input from an operator and, in response to the input, select a select region of the sensor array;

an image processor configured to receive image data captured by the sensor array and process the image data to generate a subset image that is received from the select region of the sensor array that defines a second focal plane; and a display device configured to display the subset image for viewing by the operator of the weapon, wherein the input from the operator operates to align the second focal plane with the first focal plane.

20. The weapon system of claim 19, wherein the optoelectronic device further comprises a human-machine interface for providing an input to the controller.

* * * * *